US012656042B2

(12) United States Patent
Alexander et al.

(10) Patent No.: US 12,656,042 B2
(45) Date of Patent: Jun. 16, 2026

(54) PORTABLE COOLER CONTAINER

(71) Applicant: Ember Technologies, Inc., Westlake Village, CA (US)

(72) Inventors: Clayton Alexander, Westlake Village, CA (US); Daren John Leith, Agoura Hills, CA (US); Christopher Thomas Wakeham, Solana Beach, CA (US); Mikko Juhani Timperi, San Marcos, CA (US); Rahul Mulinti, Westlake Village, CA (US)

(73) Assignee: Ember Technologies, Inc., Westlake Village, CA (US)

( * ) Notice: Subject to any disclaimer, the term of this patent is extended or adjusted under 35 U.S.C. 154(b) by 0 days.

(21) Appl. No.: 18/259,575

(22) PCT Filed: Dec. 16, 2021

(86) PCT No.: PCT/US2021/072955
§ 371 (c)(1),
(2) Date: Jun. 27, 2023

(87) PCT Pub. No.: WO2022/150242
PCT Pub. Date: Jul. 14, 2022

(65) Prior Publication Data

US 2024/0060699 A1 Feb. 22, 2024

Related U.S. Application Data

(60) Provisional application No. 63/134,419, filed on Jan. 6, 2021.

(51) Int. Cl.
*F25D 3/14* (2006.01)
*F25D 29/00* (2006.01)

(52) U.S. Cl.
CPC ..... *F25D 3/14* (2013.01); *F25D 29/001* (2013.01); *F25D 2201/14* (2013.01);
(Continued)

(58) Field of Classification Search
CPC ..... F25D 3/08; F25D 29/00; F25D 2201/00; F25D 23/06; F25D 2303/0821;
(Continued)

(56) References Cited

U.S. PATENT DOCUMENTS 1,748,324 A 2/1930 Baker
1,979,222 A * 10/1934 Goodwin ..... A47J 36/2433 62/331

(Continued)

FOREIGN PATENT DOCUMENTS

JP S52 143769 U 10/1977
JP S56 118373 U 9/1981

(Continued)

OTHER PUBLICATIONS

International Search Report and Written Opinion received in International Patent Application No. PCT/US2021/072955, dated Apr. 4, 2022, 47 pages.

(Continued)

*Primary Examiner* — Joel M Attey
*Assistant Examiner* — Ibrahim A. Michael Adeniji
(74) *Attorney, Agent, or Firm* — Knobbe, Martens, Olson & Bear LLP

(57) ABSTRACT

A portable cooler container is provided, with a payload chamber for one or more temperature sensitive or perishable goods. A cooling unit is disposed in the payload chamber. The cooling unit includes a vessel filled with a cooling material (e.g., dry ice) and closed with a lid. One or more variable apertures of the cooling unit are operable to controllably release a chilled gas (e.g., CO2 gas) generated by (Continued)

the cooling material into the payload chamber of the vessel to cool the payload.

22 Claims, 5 Drawing Sheets

(52) U.S. Cl.
CPC .... *F25D 2400/36* (2013.01); *F25D 2700/122* (2013.01); *F25D 2700/14* (2013.01)

(58) Field of Classification Search
CPC ..... F25D 2303/083; F25D 2400/36; F25D 2700/12; F25D 2400/361; F25D 3/14; F25D 29/001; F25D 2201/14; F25D 2700/122; F25D 2700/14; F25D 2303/084; F25D 2331/80; F25B 2700/12
See application file for complete search history.

(56) References Cited

U.S. PATENT DOCUMENTS

| | | | | | |
|---|---|---|---|---|---|
| 2,677,245 | A | | 5/1954 | Edmondson | |
| 3,820,355 | A | * | 6/1974 | Olivares | F25D 3/14 62/384 |
| 4,134,276 | A | * | 1/1979 | Lampard | F25D 3/125 62/383 |
| 4,194,647 | A | * | 3/1980 | Spurrier | F25D 25/00 221/256 |
| 4,195,491 | A | | 4/1980 | Roncaglione | |
| 4,288,996 | A | * | 9/1981 | Roncaglione | F25D 3/14 73/40 |
| 5,363,670 | A | * | 11/1994 | Bartilucci | F25D 29/001 62/166 |
| 5,779,089 | A | * | 7/1998 | West | F25D 3/10 220/203.11 |
| 5,950,450 | A | * | 9/1999 | Meyer | F25D 11/006 62/235.1 |
| 6,036,045 | A | * | 3/2000 | West | F17C 3/08 220/560.04 |
| 6,212,901 | B1 | * | 4/2001 | Pint | F25D 3/125 62/457.7 |
| 6,308,518 | B1 | * | 10/2001 | Hunter | F25B 21/02 62/3.6 |
| 7,451,603 | B2 | * | 11/2008 | Tuszkiewicz | F25D 17/06 62/291 |
| 10,260,792 | B1 | | 4/2019 | Frank | |
| 2005/0210884 | A1 | * | 9/2005 | Tuskiewicz | F25D 17/06 62/3.6 |
| 2006/0053828 | A1 | * | 3/2006 | Shallman | F25D 3/14 62/385 |
| 2015/0068232 | A1 | | 3/2015 | Petrov | |
| 2017/0350635 | A1 | * | 12/2017 | Thirumurugavel | F25D 3/08 |
| 2019/0323756 | A1 | * | 10/2019 | Alexander | F25D 31/00 |
| 2020/0378676 | A1 | | 12/2020 | Rowe et al. | |
| 2021/0404727 | A1 | * | 12/2021 | Alexander | F25B 21/02 |
| 2022/0196313 | A1 | * | 6/2022 | Ros | F25D 17/047 |

FOREIGN PATENT DOCUMENTS

| | | | | |
|---|---|---|---|---|
| JP | H09-126616 | A | | 5/1997 |
| JP | 2004-026174 | | | 1/2004 |
| JP | 2005 212844 | A | | 8/2005 |
| JP | 2008 116165 | A | | 5/2008 |
| KR | 1998 0076548 | A | | 11/1998 |
| KR | 200 235 997 | Y1 | | 10/2001 |
| UA | 52641 | C2 | * | 1/2003 |
| WO | WO 2019/204660 | A1 | | 10/2019 |

OTHER PUBLICATIONS

Office Action dated Sep. 26, 2025, received in European Patent Application No. 21840408.5, in 8 pages.
Japanese Office Action, regarding Japanese Patent Application No. 2023-541034, dated Jan. 6, 2026, 11 pages.

* cited by examiner

PORTABLE COOLER CONTAINER

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present disclosure is directed to a portable cooler, and more particularly to a portable cooler for shipping temperature sensitive goods.

Description of the Related Art

Portable coolers are used to store products (e.g., liquids, beverages, medicine, organs, food, etc.) in a cooled state. Some are Styrofoam containers that are often filled with ice to keep the product in a cooled state. However, the ice eventually melts, soaking the products and requiring the emptying of the liquid. Such coolers can also leak during transport, which is undesirable. Additionally, such coolers are undesirable for transporting goods across long distances due to their inability to maintain the product in a cooled state, the melting of ice and/or possible leaking of liquid from the cooler. Therefore, such coolers are undesirable for use with temperature sensitive products (e.g., food, vaccines, medicine, organ transplants, perishable material, etc.). This can result in the non-usability of the products in the cooler. For example, once potency of medicine (e.g., a vaccine) is lost, it cannot be restored, rendering the medicine ineffective and/or unusable. Another drawback of existing containers is that they are single-use containers that end up in the landfills after a single use.

SUMMARY

In accordance with one aspect of the disclosure a cooler container is provided with a payload chamber for one or more temperature sensitive or perishable goods. A cooling unit is disposed in the payload chamber. The cooling unit includes a vessel filled with a cooling material (e.g., dry ice) and closed with a lid. One or more variable apertures of the cooling unit are operable to controllably release a chilled gas (e.g., CO2 gas) generated by the cooling material into the payload chamber of the vessel to cool the payload.

In accordance with another aspect of the disclosure, a portable cooler container system is provided. The system comprises an insulated vessel having a payload chamber configured to receive a payload of one or more temperature sensitive or perishable goods. The system also comprises a lid hingedly coupled or removably coupled to the vessel and configured to seal the chamber of the vessel. The lid has one or more pressure relief valves configured to at least partially open when pressure in the chamber exceeds a predetermined pressure amount. The system also comprises a cooling unit in the vessel. The cooling unit comprises a cooling vessel defining a chamber configured to receive a cooling material therein, and a lid hingedly coupled or removably coupled to the cooling vessel and configured to seal the chamber of the cooling vessel. One or more variable apertures in one of the cooling vessel and the lid are operable to controllably release a chilled gas generated by the cooling material into the payload chamber of the vessel to cool the payload to one or more of a plurality of predetermined temperatures or temperature ranges.

In accordance with another aspect of the disclosure, a portable cooler container system is provided. The system comprises a cooling unit. The cooling unit comprises a cooling vessel defining a chamber configured to receive a cooling material therein and sized to receive a payload of one or more temperature sensitive or perishable goods adjacent one or more surfaces of the cooling material. The cooling unit also comprises a lid hingedly coupled or removably coupled to the cooling vessel and configured to seal the chamber of the cooling vessel. One or more variable apertures in one of the cooling vessel and the lid are operable to controllably release a chilled gas generated by the cooling material from the chamber of the cooling vessel to one or more of a plurality of predetermined temperatures or temperature ranges.

DETAILED DESCRIPTION

Figure 1:
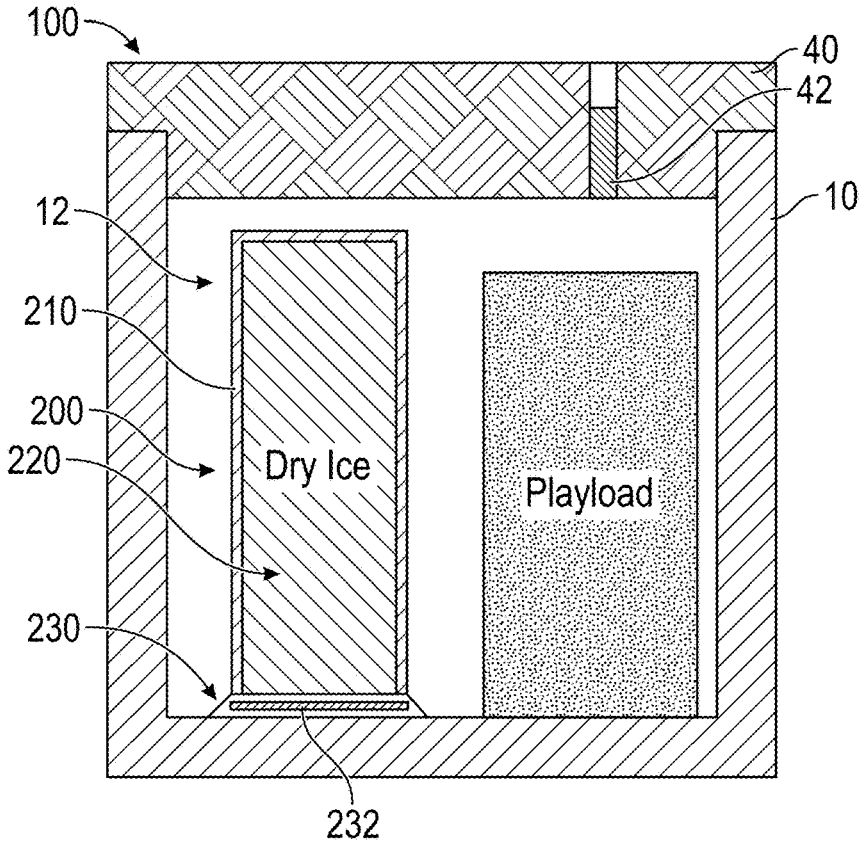
FIG. 1 is a schematic cross-sectional view of a cooler container.

FIG. 1 shows a schematic view of a cooler container assembly 100 (the "cooler container"). The cooler container 100 can include a vessel 10. The vessel 10 can in one implementation be a double-walled vessel 10, with an outer wall and an inner wall spaced inward from the outer wall to define a gap therebetween. The inner wall of the vessel 10 defines a payload chamber 12 that can receive a payload (e.g., vaccines, foodstuff, beverages). In one implementation, the gap can be under vacuum. In another implementation, the gap can be filled with an insulating material (e.g., foam).

The vessel 10 can be covered with a lid 40. In one implementation, the lid 40 can be movably coupled to the vessel 10 (e.g., by a hinge between the lid 40 and the vessel 10). In another implementation, the lid 40 can be removably coupled to the vessel 10 (e.g., so that the lid 40 can be completely decoupled from the vessel 10). In one implementation, the lid 40 is insulated (e.g., vacuum insulated double-walled, with an insulating material, such as foam between a top wall and an bottom wall thereof). The lid 40 can seal the chamber 12 when it is secured to the vessel 10. The lid 40 can include a relief valve 42 therein (e.g., spring loaded relief valve, electronic valve such as a solenoid valve). The valve 42 can operate to maintain the chamber 12 at a predetermined pressure and/or within a predetermined pressure range (e.g., above atmospheric pressure) while the lid 40 is secured to the vessel 10. Accordingly, the chamber 12 is pressurized to a lever higher than atmospheric pressure.

A cooling system 200 (e.g., dry ice canister) is disposed inside the payload chamber 12. The cooling system 200 includes a vessel 210 that can receive a cooling material (e.g., dry ice) 220 therein and be sealed with a lid 230 that closes off the vessel 210. The lid 230 can have a variable aperture (e.g. valve) 232 operable to allow an amount of chilled gas (e.g., gaseous CO2) to exit the vessel 210 into the payload chamber 12 to cool the chamber 12 (e.g., via the sublimation of dry ice), thereby cooling the payload in the chamber 12. In another implementation, the variable aperture can be in the vessel 210 instead of the lid 230.

Figure 9:
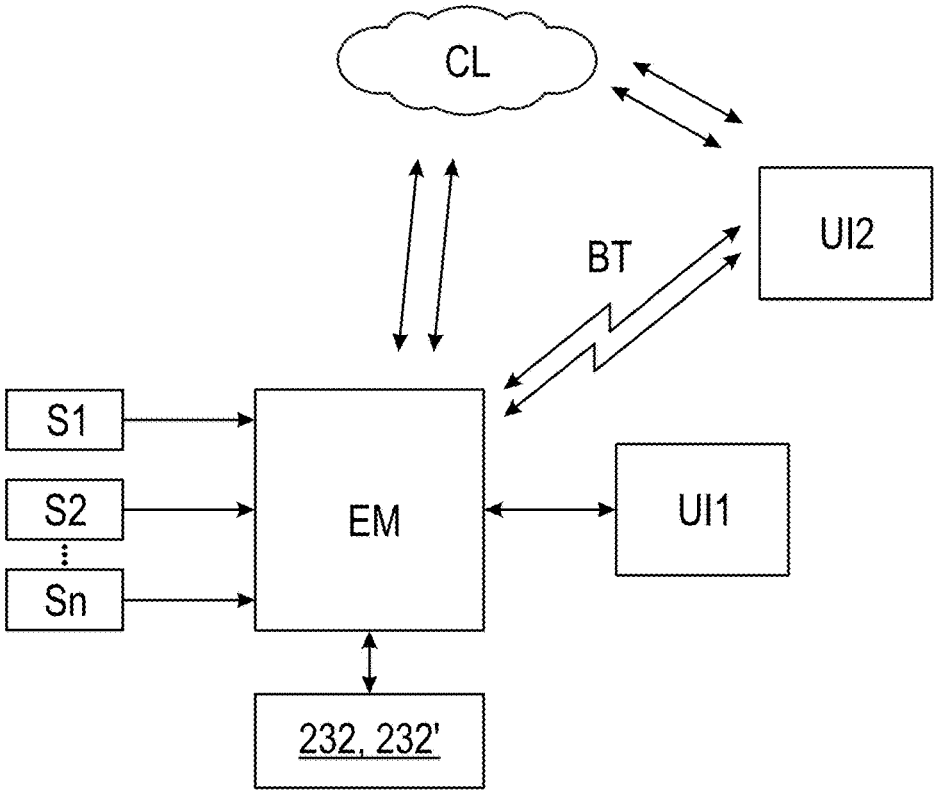
FIG. 9 is a schematic block diagram showing communication between the cooler container and a remote electronic device.

In one implementation, the variable aperture (e.g., valve) 232 is controlled electronically (e.g., by the circuitry EM, see FIG. 9). For example, the variable aperture 232 can be part of a solenoid valve or linear actuator that can be actuated to allow chilled gas to exit the vessel 210 into the payload chamber 12. The variable aperture 232 can be opened by an amount and for a duration such that an amount of chilled gas (e.g., gaseous CO2) is vented into the payload chamber 12 to bring the temperature of the payload chamber 12 to approximately a predetermined temperature and/or within a predetermined temperature range. Circuitry (e.g., EM in FIG. 9, or in the lid 230) can control the opening and closing of the variable aperture 232 (e.g., control the duty cycle of the aperture) based at least in part on sensed temperature communicated to the circuitry (e.g., in a wired manner if the sensor is on a surface of the vessel 210, wirelessly via a receiver or transceiver in the lid 230 if the sensor is in the payload chamber 12) to vent chilled gas (e.g., CO2 gas) in a controlled manner into the payload chamber 12. For example, where the sensed temperature in the chamber 12 is above a predetermined temperature and/or outside a predetermined temperature range (e.g., higher than −20 C), the circuitry can control the opening of the variable aperture 232 (e.g., to a certain amount or percentage of the full opening, and for a certain time) to vent chilled gas (e.g., CO2 gas) into the payload chamber 12. Once sensed temperature in the payload chamber 12 indicates the temperature is at approximately the predetermined temperature and/or within the predetermined temperature range, the circuitry can control the variable aperture 232 to close and disallow venting of chilled gas into the chamber 12. A power source (e.g., one or more batteries) can optionally be in the lid 230 and power the circuitry, sensors and/or variable aperture 232 discussed herein. If said venting of chilled gas into the payload chamber 12 causes the pressure in the chamber 12 to exceed the predetermined actuation pressure of the relief valve 42 in the lid 40, the relief valve 42 can open to reduce the pressure in the payload chamber 12.

As discussed above, the circuitry (e.g., in the lid 230) can control the amount and duration of the opening of the variable aperture 232, which allows controlled venting of chilled gas (e.g., CO2 gas) into the payload chamber 12. Advantageously, this allows the cooling system 200 (e.g., dry ice canister) the ability to maintain the temperature of the payload at one of multiple temperatures (e.g., depending on the nature of the payload and its temperature requirements). In one implementation, temperature requirements for different types of payload materials can be stored in a memory of the cooling system 200 that communicates with the circuitry, and the payload type can be selected (e.g., via a user interface on the lid 230, wirelessly via information communicated to the circuitry via a transceiver or receiver in the lid 230, such as from a smartphone, a tablet computer or other remote electronic device or remote control). The circuitry can then control the operation (e.g., control the amount of opening and duration of opening of the variable aperture 232) for the particular payload type (e.g., vaccines, insulin, medicine, tissue samples, etc.) to maintain it at the predetermined temperature and/or within a predetermined temperature range associated with the payload type.

In another implementation, the variable aperture (e.g., valve) 232 can be mechanically controlled (e.g., without any electronics). For example, the variable aperture 232 can be part of a pressure actuated valve that opens based on a pressure differential between the payload chamber 12 and a chamber of the vessel 210 (e.g., when pressure in the vessel 210 is greater than pressure in the payload chamber 12), where the pressure differential depends on the temperature in the payload chamber 12. Therefore, the mechanically actuated variable aperture 232 based on a pressure differential, and the pressure differential can be correlated to temperature in the payload chamber 12 so that temperature in the payload chamber 12 is controlled to a predetermined temperature and/or withing a predetermined temperature range corresponding to the pressure differential at which the variable aperture 232 operates (e.g., the variable aperture 232 can open when the pressure differential is greater than X amount, where X would be a pressure differential corresponding with a temperature of the payload chamber 12 being higher than a desired temperature and/or outside a desired temperature range for the payload type.

The cooling system 200 can be removably disposed in the payload chamber 12 (e.g., to allow the lid 230 to be removed, dry ice to be loaded into the vessel 210, and lid 230 to be coupled to the vessel 210 to seal the vessel 210). In one implementation, the lid 230 has a form factor that allows the vessel 210 to remain in a stable position in the chamber 12. In one implementation, the lid 40 can removably couple to a base surface of the chamber 12 (e.g., magnetically, via a key-slot mechanism between the lid 230 and the chamber 12).

Figure 2:
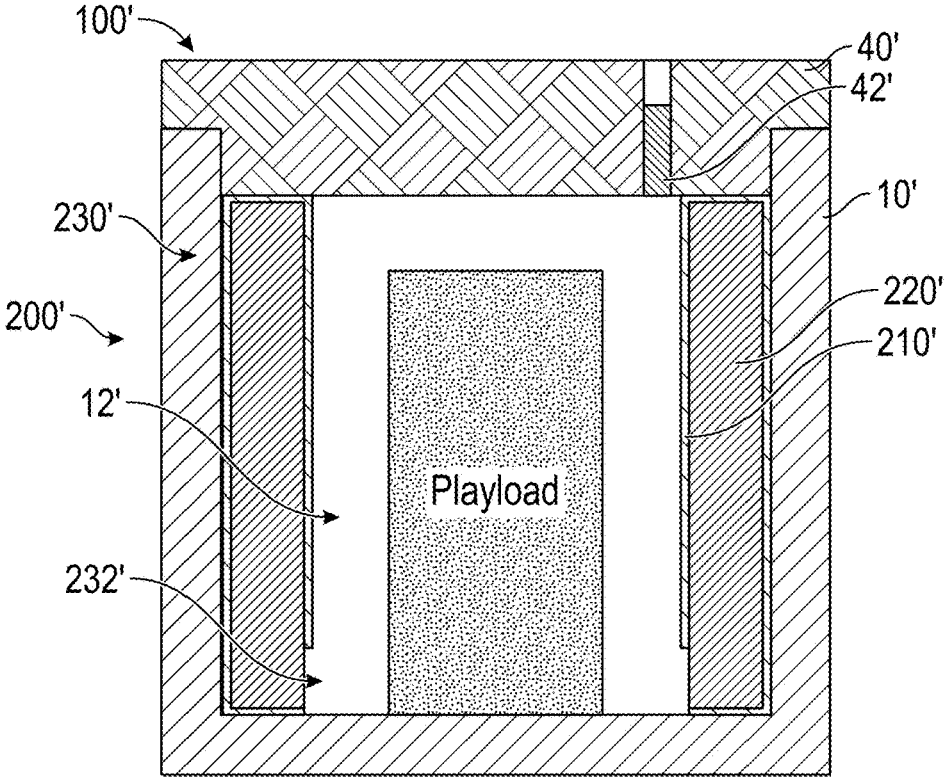
FIG. 2 is a schematic cross-sectional view of a cooler container.

FIG. 2 shows a schematic view of a cooler container system 100' ("cooler container"). Some of the features of the cooler container 100' are similar to features of the cooler container 100 in FIG. 1. Thus, reference numerals used to designate the various components of the cooler container 100' are identical to those used for identifying the corresponding components of the cooler container 100 in FIG. 1, except that a "'" has been added to the numerical identifier. Therefore, the structure and description for the various features of the cooler container 100 and how it's operated and controlled in FIG. 1 are understood to also apply to the corresponding features of the cooler container 100' in FIG. 2, except as described below. Though the features below are described in connection with the cooler container assembly 100', the features also apply to all cooler containers, such as cooler containers 100, 100", 100" disclosed herein.

The cooler container 100' differs from the cooler container 100 in the structure of the cooling system 200'. The cooling system 200' can include an annular vessel 210' filled with a cooling material (e.g. dry ice) 220, can be sealed with a lid 230'. Though not shown, the lid 230' can be detachable from the vessel 210' (e.g., to allow filling of the chamber in the vessel 210' with the cooling material). Optionally, the vessel 210' is a removable unit that can be removably disposed in the vessel 10', where an inner wall of the annular vessel 210' defines a wall of the payload chamber 12'. In another implementation, the vessel 210' is built into the vessel 10' (e.g., the cooling system 200' is not removable from the vessel 10'). The vessel 210' can have one or more (e.g., two) variable apertures 232' that can be opened or closed (e.g., by gates that move toward the base of the chamber 12' to close off the variable apertures 232'). As discussed above in connection with the cooler container 100, the variable apertures 232' can be electronically controlled (e.g., via circuitry, for example EM in FIG. 9, in or of the cooling system 200' and/or cooler container 100') or be mechanically controlled (e.g., operate based on a pressure differential between the payload chamber 12' and the chamber in the vessel 210'.

Figure 3:
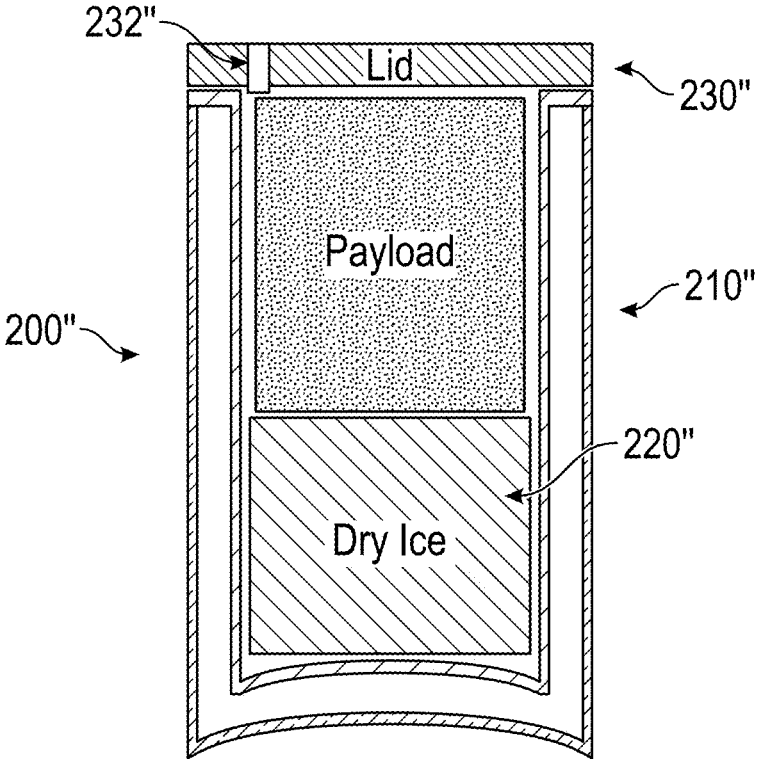
FIG. 3 is a schematic cross-sectional view of a cooler container.
Figure 4:
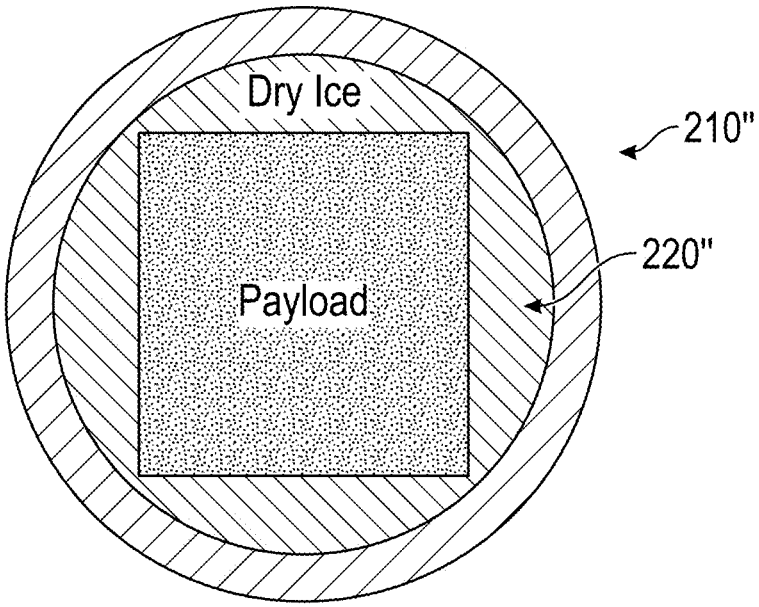
FIG. 4 is a schematic top view of the of the cooler container of FIG. 3 without the lid.
Figure 5:
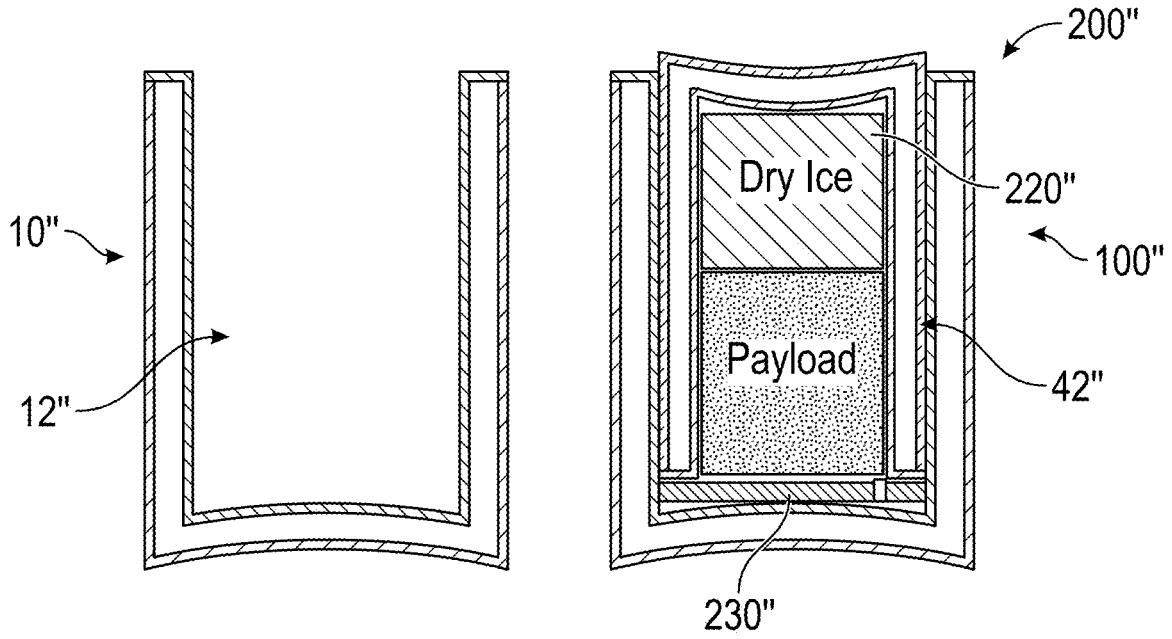
FIG. 5 is a schematic cross-sectional view of a double-walled insulated vessel before and after the cooler container of FIG. 3 is inserted therein.

FIGS. 3-5 shows a schematic view of a cooler container system 100" ("cooler container"). Some of the features of the cooler container 100" are similar to features of the cooler container 100 in FIG. 1. Thus, reference numerals used to designate the various components of the cooler container 100" are identical to those used for identifying the corresponding components of the cooler container 100 in FIG. 1, except that a "'" has been added to the numerical identifier. Therefore, the structure and description for the various features of the cooler container 100 and how it's operated and controlled in FIG. 1 are understood to also apply to the corresponding features of the cooler container 100" in FIGS. 3-5, except as described below. Though the features below are described in connection with the cooler container assembly 100", the features also apply to all cooler containers, such as cooler containers 100, 100', 100'" disclosed herein.

The cooler container 100" has a vessel 10" that can be a doubled walled vacuum insulated vessel. In other implementations, the vessel 10" is double walled with material insulation in a gap between the inner and outer wall. The vessel 10" has a chamber 12". A cooling system 200" includes a vessel 210" (e.g., a double-walled vacuum insulated vessel) with a chamber that receives a cooling material 220" (e.g., dry ice) therein and is sized to receive the payload so that it is adjacent at least a portion of the cooling material 220". In FIG. 3, the payload is disposed over the cooling material 220". The cooling system 200" also has a lid 230" that removably couples to the vessel 210" to seal the vessel 210". The lid 230" has a vent 232" (e.g., electrically or mechanically controlled) to vent chilled gas (e.g., CO2 gas generated from the sublimation of dry ice in the vessel 210") from the vessel 210". The vent 232" can open at a particular pressure setting to vent chilled gas (CO2 gas) from the vessel 210". The chilled gas flows past the payload to cool it. Optionally, an amount of cooling material 220" is disposed in the vessel 210" to maintain the payload in the vessel 210" at a predetermined temperature and/or within a predetermined temperature range. As shown in FIG. 4, the payload has a smaller perimeter than the cooling material 220" (e.g., dry ice), allowing the chilled gas generated from the sublimation of the cooling material 220" to flow past surfaces of the payload to cool the payload.

The cooling system 200" can be removably disposed (e.g., upside down) into the chamber 12" such that one or more gaps (e.g., an annular gap) are defined between an outer surface of the vessel 210" and an inner surface of the vessel 10". Optionally, a lid (not shown) can be coupled to the top of the vessel 10", and can have a vent to vent chilled gas (e.g., CO2 gas) that flows through an annulus between the outer wall of the vessel 210" and the inner wall of the vessel 10". One or more gaskets or seals can be disposed in the one or more gaps and operable to allow venting of chilled gas (e.g., CO2 gas) therethrough.

Figure 6:
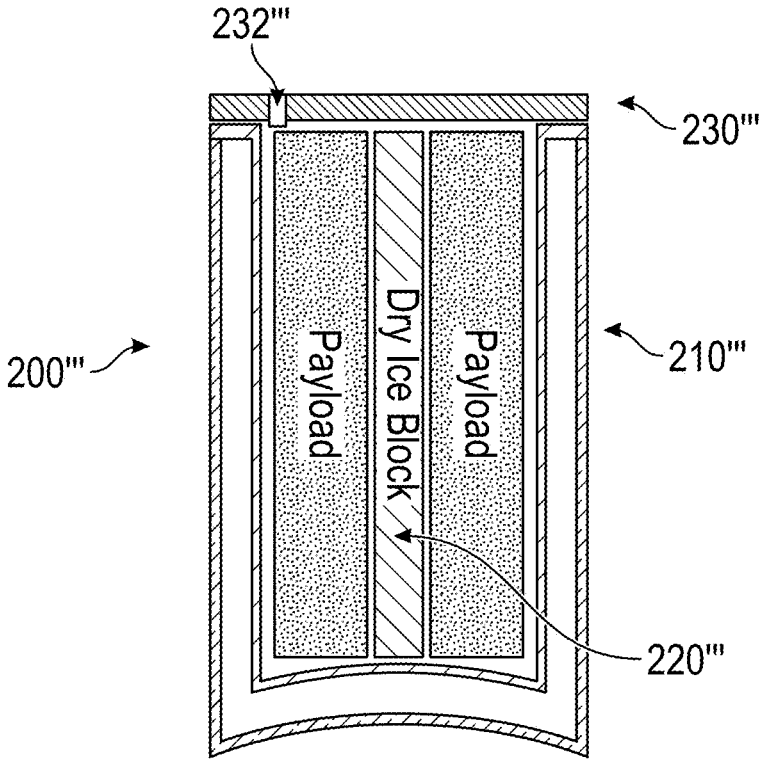
FIG. 6 is a schematic cross-sectional view of a cooler container.
Figure 7:
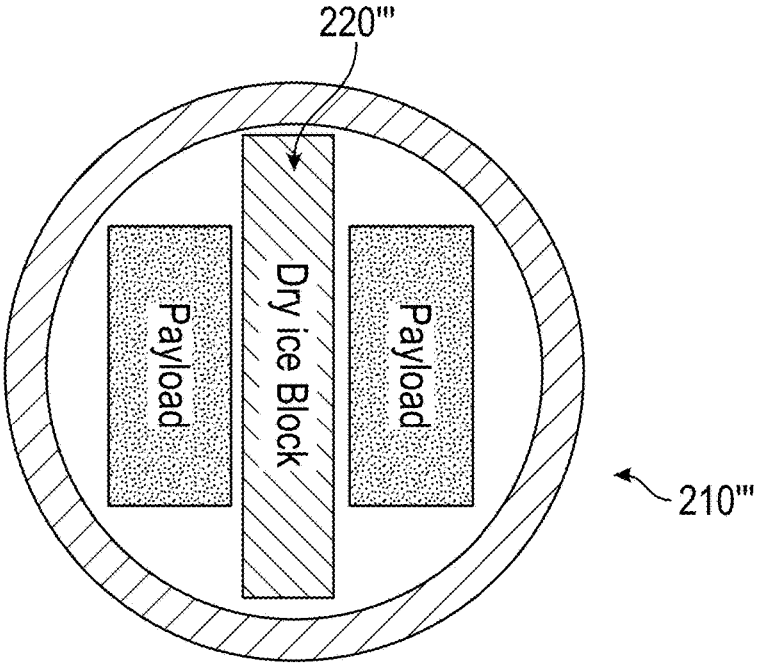
FIG. 7 is a schematic top view of the of the cooler container of FIG. 6 without the lid.
Figure 8:
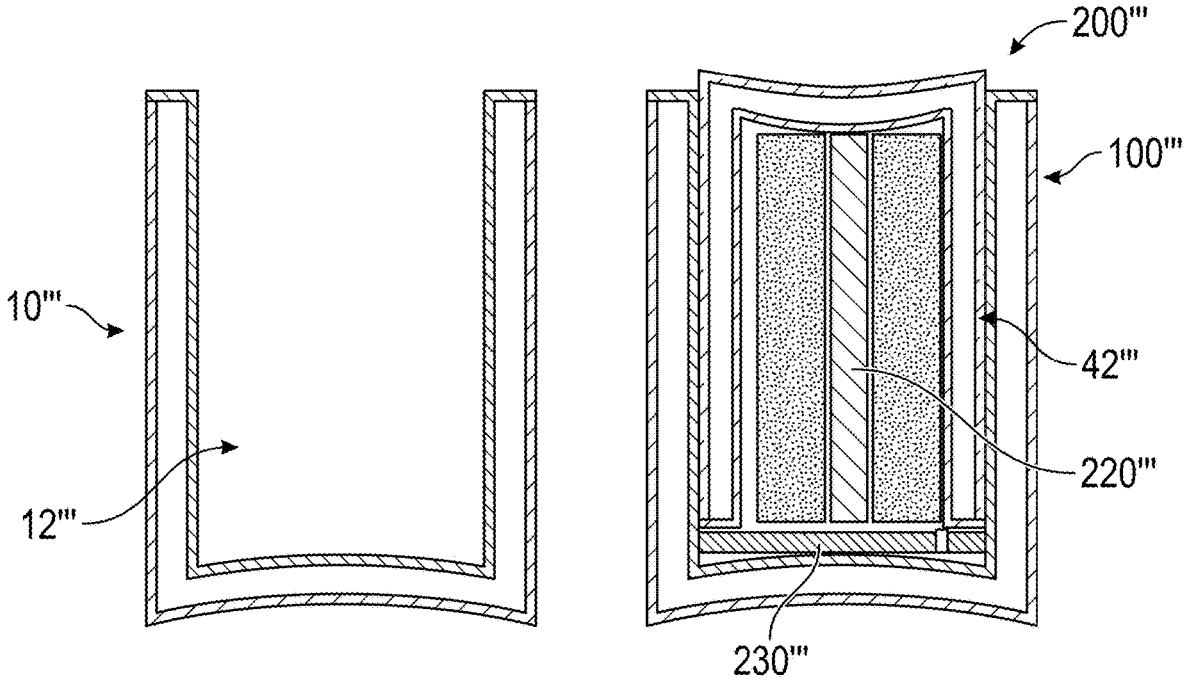
FIG. 8 is a schematic cross-sectional view of a double-walled insulated vessel before and after the cooler container of FIG. 7 is inserted therein.

FIGS. 6-8 shows a schematic view of a cooler container system 100'" ("cooler container"). Some of the features of the cooler container 100'" are similar to features of the cooler container 100" in FIGS. 3-5. Thus, reference numerals used to designate the various components of the cooler container 100'" are identical to those used for identifying the corresponding components of the cooler container 100" in FIGS. 3-5, except that a "'" has been added to the numerical identifier. Therefore, the structure and description for the various features of the cooler container 100" and how it's operated and controlled in FIGS. 3-5 are understood to also apply to the corresponding features of the cooler container 100'" in FIGS. 6-8, except as described below. Though the features below are described in connection with the cooler container assembly 100'", the features also apply to all cooler containers, such as cooler containers 100, 100', 100" disclosed herein.

The cooler container 100'" differs from the cooler container 100" in the shape of the cooling material 220'" in the vessel 210'". The cooling material 220' (e.g., dry ice) is shaped to allow payload to be disposed on either side of the cooling material 220'" allowing it to cool two, instead of one payload volumes. As shown in FIG. 7, the cooling material 220' has a greater width than depth, and has a greater width than the payload volume, so that there are gaps in the chamber of the vessel 210'" via which chilled gasses (e.g., CO2 gas) generated from the evaporation of the cooling material 220'" to flow pas the payload volume(s) to cool them.

FIG. 9 shows a block diagram of a control system for (e.g., incorporated into) the devices described herein (e.g., the cooler container assembly 100, 100', 100", 100'). In the illustrated embodiment, circuitry EM (e.g., control circuitry, microcontroller unit MCU, computer processor(s), etc.) can receive sensed information from one or more sensors S1-Sn (e.g., level sensors, volume sensors, temperature sensors, pressure sensors, orientation sensors such as gyroscopes, accelerometers, battery charge sensors, biometric sensors, load/weight sensors, Global Positioning System or GPS sensors, radiofrequency identification or RFID reader, etc.).

In one implementation, at least one temperature sensor Sn (e.g., Sn1, Sn2 and/or Sn3) is in the vessel 10, 10', 10", 10' or lid 40, 40', 40", 40' and exposed to the chamber 12, 12', 12", 12'" to sense a temperature in the chamber 12, 12', 12", 12' ". In another implementation, additionally or alternatively, at least one temperature sensor Sn, Ta is on the vessel 10, 10', 10", 100'" or lid 40, 40', 40", 40'" and exposed to the outside of the container assembly 100, 100', 100", 100'" to measure ambient temperature. In one implementation, the RFID reader in the vessel 10, 10', 10", 10'" or lid 40, 40', 40", 40'" can read RFID tags of components (e.g., medication, vials, liquid containers, food packages) placed in the chamber 12, 12', 12", 12'". The RFID reader can optionally log when the payload contents are inserted into the chamber 12, 12', 12", 126'", and additionally or alternatively the RFID reader can optionally log when each of the one or more of the payload contents is removed from the chamber 12, 12', 12", 12' to track their position relative to the vessel 10, 10', 10", 100'" and communicate this information to the circuitry EM (e.g., to a memory of the circuitry EM).

In one implementation, one or more of the sensors S1-Sn can include a pressure sensor. The pressure sensor can optionally sense ambient pressure, which can be indicative of an altitude of the cooler container assembly 100, 100', 100", 100'". Optionally, the pressure sensor communicates sensed pressure information to the circuitry EM, which can optionally log or record the data from the pressure sensor and/or can operate one or more components of the cooling system 200, 200', as discussed above based at least in part on the sensed pressure information from the pressure sensor (e.g., which can be indicative of temperature in the chamber 12, 12', 12", 12'" to maintain the chamber 12, 12', 12", 12'" at a desired temperature or temperature range). Such pressure sensor(s) can advantageously allow the cooling system 200, 20' to operate such that the chamber 12, 12', 12", 12' is at a desired temperature or temperature range while the cooler container assembly 100, 100', 100", 100' in in transit (e.g., in high altitude locations), such as on an airplane or truck.

In one implementation, one or more of the sensors S1-Sn can include an accelerometer. The accelerometer can optionally sense motion (e.g., sudden movement) of the cooler container assembly 100, 100', 100", 100'". Optionally, the accelerometer communicates with the circuitry EM, which can optionally log or record the data from the accelerometer and/or can operate one or more components of the cooling system 200, 200' based at least in part on the sensed information from the accelerometer. Such accelerometer(s) can advantageously sense, for example, when the cooler container assembly 100, 100', 100", 100' has been dropped (e.g., from an unsafe height) or experienced a shock, for example while in transit, such as on an airplane or truck. In one implementation, the accelerometer can also provide the circuitry EM with sensed orientation information of the cooler container assembly 100, 100', 100", 100'. In another implementation, a separate orientation sensor (e.g., a gyroscope), can sense an orientation of the cooler container assembly 100, 100', 100", 100'" and communicate the sensed orientation information to the circuitry EM, which can optionally log or record the data from the orientation sensor and/or can operate one or more components of the cooling system 200, 200' based at least in part on the sensed orientation information.

The circuitry EM can be housed in or on the container vessel 10, 10', 10", 10'" or lid 40, 40', 40", 40'". The circuitry EM can receive information from and/or transmit information (e.g., instructions) to the cooling system 200, 200' and optionally to one or more power storage devices PS (e.g., batteries, such as to charge the batteries or manage the power provided by the batteries to the one or more heating or cooling elements).

Optionally, the circuitry EM can include a wireless transmitter, receiver and/or transceiver to communicate with (e.g., transmit information, such as sensed temperature and/or position data, to and receive information, such as user instructions, from one or more of: a) a user interface UI1 on the unit (e.g., on the body of the container vessel 10, 10', 10", 10'" or lid 40, 40', 40", 40"), b) an electronic device ED (e.g., a mobile electronic device such as a mobile phone, PDA, tablet computer, laptop computer, electronic watch, a desktop computer, remote server, cloud server), c) via the cloud CL, or d) via a wireless communication system such as WiFi, broadband network and/or Bluetooth BT. For example, the circuitry EM can have a cell radio antenna or cell radio (e.g., LTE cell radio) via which it can communicate information (e.g., GPS location, sensed temperature in the chamber 12, 12', 12", 12'", ambient temperature, etc.) wirelessly (e.g., to the cloud CL, to a remote electronic device, such as a smartphone, etc.). A user can then track a location of the container 100, 100', 100", 100'" (e.g., via a website or app on a smartphone). Additionally or alternatively, the circuitry EM can report data sensed by one or more of the sensors S1-Sn (e.g., sensed ambient temperature, sensed temperature in the chamber 12, 12', 12", 12'", sensed pressure, sensed humidity outside the chamber 12, 12', 12", 12'", sensed humidity inside the chamber 12, 12', 12", 12"), for example wirelessly, to a remote electronic device or the cloud CL (e.g., transmit a report to a pharmacy or medical institution with a log temperature, pressure and/or humidity information of the contents of the cooler container assembly 100, 100', 100", 100'" during transit to said pharmacy or medical institution). The electronic device ED can have a user interface UI2, that can display information associated with the operation of the cooler container assembly 100, 100', 100", 100'", and that can receive information (e.g., instructions) from a user and communicate said information to the cooler container assembly 100, 100', 100", 100'" (e.g., to adjust an operation of the cooling system 200, 200').

In operation, the cooler container assembly 100, 100', 100", 100" can operate to maintain the chamber 12, 12', 12", 12'" of the container vessel 100 at a preselected temperature and/or within a predetermined temperature range.

Optionally, the circuitry EM of the cooler container 100, 100', 100", 100'" can communicate (e.g., wirelessly) information to a remote location (e.g., cloud based data storage system, remote computer, remote server, mobile electronic device such as a smartphone or tablet computer or laptop or desktop computer) and/or to the individual carrying the container (e.g., via their mobile phone, via a visual interface on the container, etc.), such as a temperature history of the chamber 12, 12', 12", 12'" to provide a record that can be used (e.g., to evaluate the efficacy of the medication in the container, to evaluate if contents in the chamber 12, 12', 12", 12'" have spoiled, etc.) and/or alerts on the status of the chamber 12, 12', 12", 12'" and/or contents in the chamber 12, 12', 12", 12".

In one implementation, the one or more sensors S1-Sn of the cooler container assembly 100, 100', 100", 100'" can include one more Global Positioning System (GPS) sensors for tracking the location of the cooler container assembly 100, 100', 100", 100". The location information can be communicated, as discussed above, by a transmitter (e.g., cell radio antenna or cell radio, such as LTE cell radio) and/or transceiver associated with the circuitry EM to a remote location (e.g., a mobile electronic device, a cloud-based data storage system, etc.). In one implementations, the GPS location is communicated (e.g., automatically, not in response to a query or request) by the circuitry EM at regular intervals (e.g., every minute, every 5 minutes, every 10 minutes, every 15 minutes, etc.). In another implementation, the GPS location is communicated by the circuitry EM upon receipt of a request or query, such as from the user (e.g., via an app or website via which the user can track the location of the cooler container 100, 100', 100", 100'").

Figure 10:
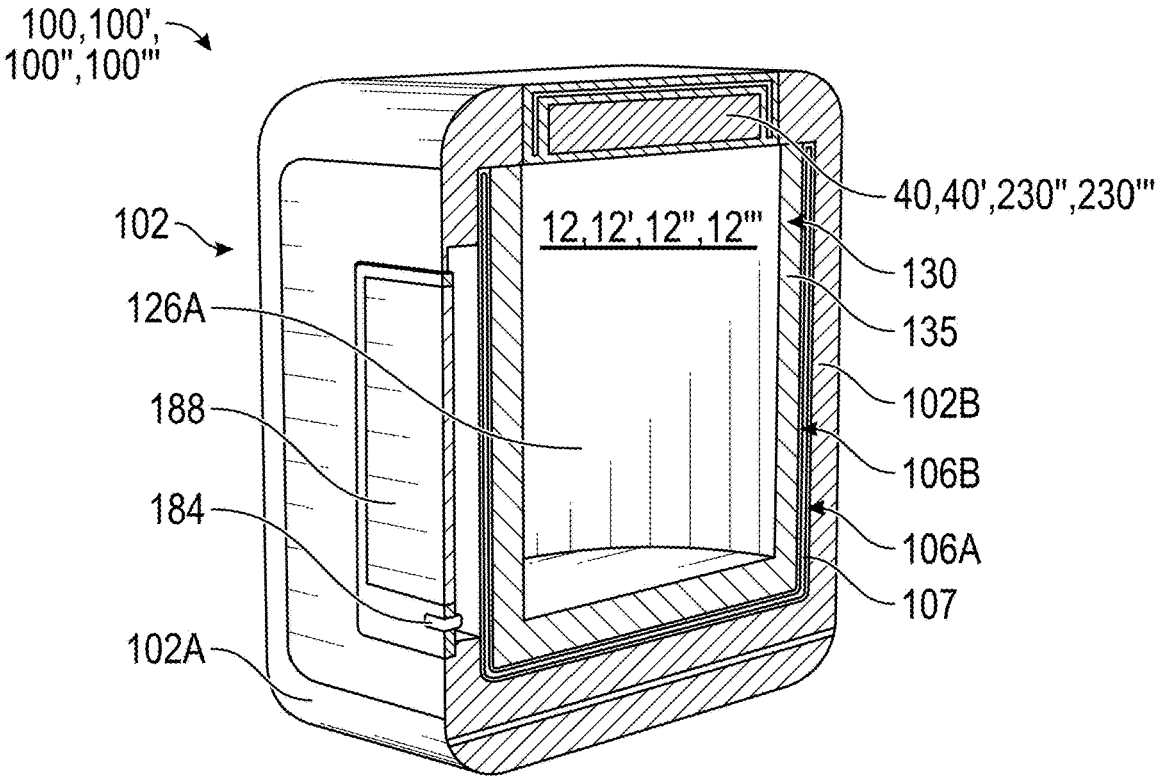
FIG. 10 is a schematic cross-sectional view of a cooler container.

The cooler container 100, 100', 100", 100'" can have the form shown in FIG. 10, and can optionally have a visual display 188 (e.g., electrophoretic display). Though not shown, the cooler container in FIG. 10 can include the cooling system 200, 200', 200", 200'" described above (e.g., which can be removably disposed in the chamber of the container). Optionally, the visual display 188 can display a shipping label (e.g. an electronic shipping label). The cooler container 100, 100', 100", 100'" can optionally have a user interface 184 (e.g., depressible button, touch sensitive button, capacitive sensing button) that allows a user to automatically change the sender and addressee on the shipping label by manually engaging the user interface.

Though FIG. 10 shows a cross-section of the container 100, 100', 100", 100'", one of skill in the art will recognize that the container 100, 100', 100", 100'" in one implementation is symmetrical about the cross-sectional plane (e.g. the container has a generally box-like or cube outer shape, such as with a square cross-section along a transverse plane to the cross-sectional plane in FIG. 10), which can advantageously maximize the number of containers 100, 100', 100", 100'" that can be stored in a given volume (e.g., a delivery truck). The container 100, 100', 100", 100'" can have other suitable shapes (e.g., cylindrical, rectangular, etc.).

The cooler container 100, 100', 100", 100'" has an outer housing 102. Optionally, the outer housing 102' has one or more portions. In the illustrated implementation, the outer housing 102 optionally has two portions, including a first (e.g., outer) portion 102A and a second (e.g., inner) portion 102B. In other implementations, the outer housing 102 can have fewer (e.g., one) or more (e.g., three, four, etc.) portions.

The first portion 102A optionally provides an outer shell. As shown in FIG. 10, the first portion 102A optionally covers at least some (e.g., but not all) of the outer surface of the container 100, 100', 100", 100'". For example, in one implementation, the first portion 102A covers at least the edges of the container 100, 100', 100", 100'". In one implementation, the first portion 102A only covers the edges of the container 100, 100', 100", 100'". In one implementation, the first portion 102A is made of an impact resistant material, such as plastic. Other suitable materials can be used. In another implementation, the first portion 102A can additionally or alternatively be made of a thermally insulative material.

The second portion 102B is optionally made of a thermally insulative material, such as a foam material. Other suitable materials can be used. In another implementation, the second portion 102B can additionally or alternatively be made of an impact resistant (e.g., compressible) material.

In some implementations, the outer housing 102 includes only the first portion 102A (e.g., the housing 102 is defined only by the first portion 102A) and excludes the second portion 102B. In some implementations, the outer housing 102 includes only the second portion 102B (e.g., the housing 102 is defined only by the second portion 102B) and excludes the first portion 102A.

The container 100, 100', 100", 100'" in one implementation optionally includes a vacuum insulated chamber 107 defined between an outer wall 106A and an inner wall 106B (e.g., a double-walled insulated chamber), where the walls 106A, 106B extend along the circumference and base of a payload chamber 12, 12', 12", 12'" of the container 100, 100', 100", 100". Therefore, the chamber 12, 12', 12", 12'" that receives the perishable or temperature sensitive contents (e.g., medicine, food, other perishables, etc.) is surrounded about its circumference and base by the vacuum insulated chamber 107, which inhibits (e.g., prevents) heat transfer (e.g., loss of cooling) from the chamber 12, 12', 12", 12'" via its circumference or base. In another implementation, the container 100, 100', 100", 100'" excludes a vacuum insulated chamber.

The cooler container 100, 100', 100", 100'" optionally includes a phase change material 135 that can be disposed in the container 100, 100', 100", 100'". In one implementation, the phase change material (PCM) 135 or thermal mass is provided (e.g., contained) in a sleeve 130 that is surrounded by the inner wall 106B and that defines an inner wall 126A of the chamber 12, 12', 12", 12'". In another implementation, the phase change material or thermal mass can alternatively be disposed in one or more packs (e.g., one or more ice packs) in the chamber 12, 12', 12", 12'", where the chamber 12, 12', 12", 12'" is defined by the inner wall 106B. In another implementation, the phase change material 135 or thermal mass can be provided in a sleeve 130 as well as in separate pack(s) (e.g., one or more ice packs) inserted into the chamber 12, 12', 12", 12'" (e.g., about the perishable contents). In another implementation of the container 100, 100', 100", 100'", the phase change material 135 is excluded.

The chamber 12, 12', 12", 12'" can be sealed with the lid 40, 40', 230", 230". Optionally, the lid 40, 40', 230", 230'" includes at least a portion 410 made of a thermally insulative material (e.g., a foam material). In another implementation, the lid 40, 40', 230", 230'" can optionally be hollow and have a space into which a phase change material can be inserted to further reduce the heat transfer out of the chamber 12, 12', 12", 12'".

As discussed above, the container 100, 100', 100", 100'" includes an electronic display screen 188 (e.g., on a side surface, on a top surface, of the container 100, 100', 100", 100'"). The display screen 188 can optionally be an electronic ink or E-ink display (e.g., electrophoretic ink display). In another implementation, the display screen 188 can be a digital display (e.g., liquid crystal display or LCD, light emitting diode or LED, etc.). Optionally, the display screen 188 can display a label (e.g., a shipping label with one or more of an address of sender, an address of recipient, a Maxi Code machine readable symbol, a QR code, a routing code, a barcode, and a tracking number), but can optionally additionally or alternatively display other information (e.g., temperature history information, information on the contents of the container 100, 100', 100", 100'".

The cooler container assembly 100, 100', 100", 100'" can optionally also include a user interface 184. In FIG. 10, the user interface 184 is on the side of the container 100, 100', 100", 100'". In another implementation, the user interface 184 is disposed on a top surface (e.g., a corner) of the housing 102 of the container 100, 100', 100", 100'" and/or a surface of the lid 400, 40', 230", 230'". The user interface 184 can optionally be a button (e.g., a "return home" button). In one implementation, the user interface 184 is a depressible button. In another implementation, the user interface 184 is a capacitive sensor (e.g., touch sensitive sensor, touch sensitive switch). In another implementation, the user interface 184 is a sliding switch (e.g., sliding lever). In another implementation, the user interface 184 is a rotatable dial. In still another implementation, the user interface 184 can be a touch screen portion (e.g., separate from or incorporated as part of the display screen 188). Advantageously, actuation of the user interface 184 can alter the information shown on the display 188, such as the form of a shipping label shown on an E-ink display 188. For example, actuation of the user interface 184, can switch the text associated with the sender and receiver, allowing the cooler container assembly 100, 100', 100", 100'" to be shipped back to the sender once the receiving party is done with it. Additionally or alternatively, actuation of the user interface 184 causes (e.g., automatically causes) a signal to be sent by circuitry in the assembly 100, 100', 100", 100'", as discussed above, to a shipping carrier (e.g., UPS, FedEx, DHL) informing the shipping carrier that a shipping label (e.g., new shipping label) has been assigned to the portable cooler 100, 100', 100", 100'" and that the cooler is ready for pick-up and shipping.

Advantageously, the cooler container 100, 100', 100", 100'" can be reused multiple times (e.g., 500 times, 1000 times, 1500 times, 20000 times), providing a sustainable cooler container for the delivery of perishable material (e.g., medicine, food, other perishables). Additionally, the container 100, 100', 100", 100'" is easy to use and streamlines the shipping process. For example, the user interface 184 (e.g., button) makes it easy to return the container without having to print a new shipping label and without having to separately contact the shipping carrier for pickup, thereby improving the productivity of personnel handling the packages. The cooler containers 100, 100', 100", 100'" can be stacked, for example in columns of 6 containers 100, 100', 100", 100'", allowing a user to stack and unstack them without the need for a ladder.

FIGS. 1-8, 10 show the cooler container 100, 100', 100", 100'" in cross-section. In one implementation, the vessel 10, 10', 10", 10'" can have a cylindrical form factor (e.g., defined by rotating the walls of the vessel 10, 10', 10", 10'" shown in the figures about a central axis thereof. The corresponding lid 40, 40', 40", 40'" can also have a circular form factor to fit the circular opening of the cylindrically shaped vessel 10, 10', 10", 10'". In another implementation, the vessel 10, 10', 10", 10'" can have a cube shaped form factor. The chamber 12, 12', 12", 12'" can similarly be cube shaped, or can be cylindrical.

ADDITIONAL EMBODIMENTS

In embodiments of the present disclosure, a portable cooler container system may be in accordance with any of the following clauses:

Clause 1. A portable cooler container system, comprising:
- an insulated vessel having a payload chamber configured to receive a payload of one or more temperature sensitive or perishable goods;
- a lid hingedly coupled or removably coupled to the vessel and configured to seal the chamber of the vessel, the lid having one or more pressure relief valves configured to at least partially open when pressure in the chamber exceeds a predetermined pressure amount; and
- a cooling unit in the vessel, comprising
  - a cooling vessel defining a chamber configured to receive a cooling material therein,
  - a lid hingedly coupled or removably coupled to the cooling vessel and configured to seal the chamber of the cooling vessel, and
  - one or more variable apertures in one of the cooling vessel and the lid that are operable to controllably release a chilled gas generated by the cooling material into the payload chamber of the vessel to cool the payload to one or more of a plurality of predetermined temperatures or temperature ranges.

Clause 2. The system of any preceding claim, wherein the vessel is vacuum insulated.

Clause 3. The system of any preceding claim, wherein the one or more pressure relief valves in the lid are electrically operated or operated mechanically based on a pressure differential on opposite sides of the lid.

Clause 4. The system of any preceding claim, wherein the cooling vessel is a double-walled insulated vessel.

Clause 5. The system of any preceding claim, wherein the cooling vessel is a double-walled vacuum insulated vessel.

Clause 6. The system of any preceding claim, wherein the cooling material is dry ice.

Clause 7. The system of any preceding claim, wherein the cooling material generates a chilled gas via evaporation or sublimation.

Clause 8. The system of any preceding claim, wherein the chamber of the cooling vessel is an annular chamber.

Clause 9. The system of any preceding claim, wherein the chamber of the cooling vessel is a cylindrical chamber.

Clause 10. The system of any preceding claim, wherein the one or more variable apertures are electrically operated or operated mechanically based on a pressure differential between the chamber of the cooling vessel and the payload chamber, the pressure differential being indicative of a temperature in the payload chamber.

Clause 11. The system of any preceding claim, wherein the one or more variable apertures are controlled so that one or both of an amount the one or more variable apertures are opened and a duration of said opening of the one or more variable apertures cool the payload chamber to said one of a plurality of predetermined temperatures or temperature ranges.

Clause 12. The system of any preceding claim, wherein the one or more variable apertures are electrically operated via circuitry of the cooling unit, the circuitry configured to control one or both of the amount the one or more variable apertures are opened and the duration of said opening of the one or more variable apertures to allow a controlled amount of chilled gas to exit the chamber of the cooling vessel into the payload chamber to cool the payload chamber to a predetermined temperature or temperature range.

Clause 13. The system of any preceding claim, wherein each of the plurality of predetermined temperatures or temperature ranges corresponds to a preferred temperature for a payload type.

Clause 14. The system of any preceding claim, wherein the circuitry receives a user selected predetermined temperature or temperature range manually via a user interface on the cooling vessel or lid of the cooling unit or wirelessly from a remote electronic device.

Clause 15. The system of any preceding claim, wherein the cooling unit is removably disposed in the vessel.

Clause 16. A portable cooler container system, comprising:
- a cooling unit, comprising
  - a cooling vessel defining a chamber configured to receive a cooling material therein and sized to receive a payload of one or more temperature sensitive or perishable goods adjacent one or more surfaces of the cooling material,
  - a lid hingedly coupled or removably coupled to the cooling vessel and configured to seal the chamber of the cooling vessel, and
  - one or more variable apertures in one of the cooling vessel and the lid that are operable to controllably release a chilled gas generated by the cooling material from the chamber of the cooling vessel to one or more of a plurality of predetermined temperatures or temperature ranges.

Clause 17. The system of any preceding claim, further comprising an insulated vessel having a chamber configured to removably receive the cooling unit therein, one or more gaps defined between an outer wall of the cooling vessel and an inner wall of the insulated vessel.

Clause 18. The system of any preceding claim, wherein the one or more gaps is an annular gap.

Clause 19. The system of any preceding claim, wherein the insulated vessel is vacuum insulated.

Clause 20. The system of any preceding claim, further comprising one or more gaskets or seals disposed between the outer surface of the cooling vessel and an inner surface of the insulated vessel, the one or more gaskets configured to allow venting of chilled gas via the one or more gaps.

Clause 21. The system of any preceding claim, wherein the one or more variable apertures are electrically operated or operated mechanically based on a pressure differential between an interior and an exterior of the chamber of the cooling vessel.

Clause 22. The system of any preceding claim, wherein the one or more variable apertures are electrically operated via circuitry in the lid of the cooling unit, the circuitry configured to control one or both of an amount the one or more variable apertures are opened and a duration of said opening of the one or more variable apertures to allow a controlled amount of chilled gas to exit the chamber of the cooling vessel.

Clause 23. The system of any preceding claim, wherein the cooling material has a larger form factor than the payload.

Clause 24. The system of any preceding claim, wherein the cooling material is disposed between two payload volumes.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A portable cooler container system, comprising:

a thermally insulated vessel having a payload chamber configured to receive a payload of one or more temperature sensitive or perishable goods;

a first lid hingedly coupled or removably coupled to the thermally insulated vessel and configured to seal the chamber of the thermally insulated vessel, the first lid having one or more pressure relief valves configured to at least partially open when pressure in the chamber exceeds a predetermined pressure amount; and a cooling unit removably disposed in the payload chamber of the thermally insulated vessel that receives the payload so that the payload and cooling unit are in a single chamber, comprising a cooling vessel defining a chamber configured to receive a cooling material therein, a second lid hingedly coupled or removably coupled to the cooling vessel and configured to seal the chamber of the cooling vessel, the second lid configured to removably couple to a base surface of the payload chamber, and one or more variable apertures in one of the cooling vessel and the second lid that are operable to controllably release a chilled gas generated by the cooling material into the payload chamber of the thermally insulated vessel to cool the payload to one or more of a plurality of predetermined temperatures or temperature ranges.

2. The system of claim 1, wherein the thermally insulated vessel is vacuum insulated.

3. The system of claim 1, wherein the one or more pressure relief valves in the first lid are electrically operated or operated mechanically based on a pressure differential on opposite sides of the first lid.

4. The system of claim 1, wherein the cooling vessel is a double-walled insulated vessel.

5. The system of claim 1, wherein the cooling material generates a chilled gas via evaporation or sublimation.

6. The system of claim 1, wherein the chamber of the cooling vessel is an annular chamber.

7. The system of claim 1, wherein the one or more variable apertures are electrically operated or operated mechanically based on a pressure differential between the chamber of the cooling vessel and the payload chamber, the pressure differential being indicative of a temperature in the payload chamber.

8. The system of claim 1, wherein the one or more variable apertures are controlled so that one or both of an amount the one or more variable apertures are opened and a duration of said opening of the one or more variable apertures cool the payload chamber to said one of a plurality of predetermined temperatures or temperature ranges.

9. The system of claim 8, wherein the one or more variable apertures are electrically operated via circuitry of the cooling unit, the circuitry configured to control one or both of the amount the one or more variable apertures are opened and the duration of said opening of the one or more variable apertures to allow a controlled amount of chilled gas to exit the chamber of the cooling vessel into the payload chamber to cool the payload chamber to a predetermined temperature or temperature range.

10. The system of claim 9, wherein each of the plurality of predetermined temperatures or temperature ranges corresponds to a preferred temperature for a payload type.

11. The system of claim 10, wherein the circuitry receives a user selected predetermined temperature or temperature range manually via a user interface on the cooling vessel or second lid of the cooling unit or wirelessly from a remote electronic device.

12. The system of claim 1, wherein the cooling unit is removably disposed in the thermally insulated vessel.

13. The system of claim 1, further comprising a display screen disposed on one or both of the thermally insulated vessel and the first lid, the display screen configured to selectively display shipping information for the portable cooler container.

14. The system of claim 13, further comprising a button or touch screen manually actuatable by a user to cause circuitry electrically connected to the display screen to one or both of a) automatically switch sender and recipient information on the display screen to facilitate return of the portable cooler container to a sender and b) automatically wirelessly send a signal to a shipping carrier to alert the shipping carrier that a new electronic shipping label has been issued and that the portable cooler container is ready for pickup.

15. A portable cooler container system, comprising:

a cooling unit, comprising a cooling vessel defining a chamber configured to receive a cooling material therein and sized to receive a payload of one or more temperature sensitive or perishable goods adjacent one or more surfaces of the cooling material so that the one or more temperature sensitive or perishable goods and the cooling material are in a single chamber, a lid hingedly coupled or removably coupled to the cooling vessel and configured to seal the chamber of the cooling vessel, and one or more variable apertures in one of the cooling vessel and the lid that are operable to controllably release a chilled gas generated by the cooling material from the chamber of the cooling vessel to one or more of a plurality of predetermined temperatures or temperature ranges.

16. The system of claim 15, further comprising an insulated vessel having a chamber configured to removably receive the cooling unit therein, one or more gaps defined between an outer wall of the cooling vessel and an inner wall of the insulated vessel.

17. The system of claim 16, wherein the one or more gaps is an annular gap.

18. The system of claim 16, wherein the insulated vessel is vacuum insulated.

19. The system of claim 16, further comprising one or more gaskets or seals disposed between the outer wall of the cooling vessel and the inner wall of the insulated vessel, the one or more gaskets configured to allow venting of chilled gas via the one or more gaps.

20. The system of claim 15, wherein the one or more variable apertures are electrically operated or operated mechanically based on a pressure differential between an interior and an exterior of the chamber of the cooling vessel.

21. The system of claim 20, wherein the one or more variable apertures are electrically operated via circuitry in the lid of the cooling unit, the circuitry configured to control one or both of an amount the one or more variable apertures are opened and a duration of said opening of the one or more variable apertures to allow a controlled amount of chilled gas to exit the chamber of the cooling vessel.

22. The system of claim 15, wherein the cooling material is disposed between two payload volumes.

* * * * *